United States Patent [19]

Bergmann

[11] 4,323,118

[45] Apr. 6, 1982

[54] APPARATUS FOR CONTROLLING AND PREVENTING OIL BLOWOUTS

[76] Inventor: Conrad E. Bergmann, 1365 Lincoln Ave., San Jose, Calif. 95125

[21] Appl. No.: 118,578

[22] Filed: Feb. 4, 1980

[51] Int. Cl.[3] ..... E21B 33/037

[52] U.S. Cl. ..... 166/96; 166/97; 166/356; 166/364; 166/368; 169/69

[58] Field of Search ..... 166/363, 364, 368, 79, 166/95, 96, 97, 68, 75, 85, 356; 175/7; 405/60, 211; 169/49, 69

[56] References Cited

U.S. PATENT DOCUMENTS

| | | | |
|---|---|---|---|
| 59,782 | 11/1866 | Shoupe | 166/68 |
| 1,520,288 | 12/1924 | Featherstone | 169/49 |
| 1,807,498 | 5/1931 | Teed | 166/95 |
| 1,830,061 | 11/1931 | Howe | 166/79 |
| 1,857,788 | 5/1932 | Murphy | 166/79 X |
| 1,859,606 | 5/1932 | Sievern et al. | 166/79 |
| 2,058,276 | 10/1936 | Wagoner | 166/97 |
| 3,380,519 | 4/1968 | Fowler | 175/7 X |
| 3,527,294 | 9/1970 | Weiss et al. | 175/7 X |
| 3,554,290 | 1/1971 | Verdin | 169/69 |
| 3,664,429 | 5/1972 | Jones | 169/69 |
| 3,724,555 | 4/1973 | Chiasson et al. | 169/69 |
| 3,815,682 | 6/1974 | Chiasson et al. | 169/69 |
| 4,086,960 | 5/1978 | Haynes | 166/75 R X |

OTHER PUBLICATIONS

Article entitled BLOWOUT in publication "The Work Boat", Nov. 1979, pp. 45–48 and 89–91.

*Primary Examiner*—Ernest R. Purser

*Attorney, Agent, or Firm*—Jack M. Wiseman; Francis W. Anderson

[57] ABSTRACT

Apparatus for controlling and preventing an oil blowout comprising a hollow frustoconical dome which is disposable over the end of a well discharge pipe or an offshore rig discharge pipe. At the top of the hollow dome is an axially disposed main valve for the blowoff of oil or gas escaping from the discharge pipe. A plurality of concentrically disposed two-way valves are disposed at the top of the dome about the main valve. With the main valve and the concentrically disposed valves open for the blow off of liquids and fluids, the dome is lowered over the discharge pipe. When the dome is fully lowered, it seats on the bottom surface surrounding the outlet of the discharge pipe. Concrete is poured around the dome to seal the dome to the bottom surface. Connected to the concentrically disposed valves are conduits for conducting gas and oil escaping from the discharge pipe to a storage facility, such as a barge, tank or the like, when the concentrically disposed valves are open for storing oil or gas. Flexible cables are connected to the concentrically disposed valves for opening and closing the same from remote locations. In the event of a fire, the concentrically disposed valves are selectively closed in the fire zones to shut off a supply of fuel to the fire in the fire zones.

7 Claims, 5 Drawing Figures

Fig_1
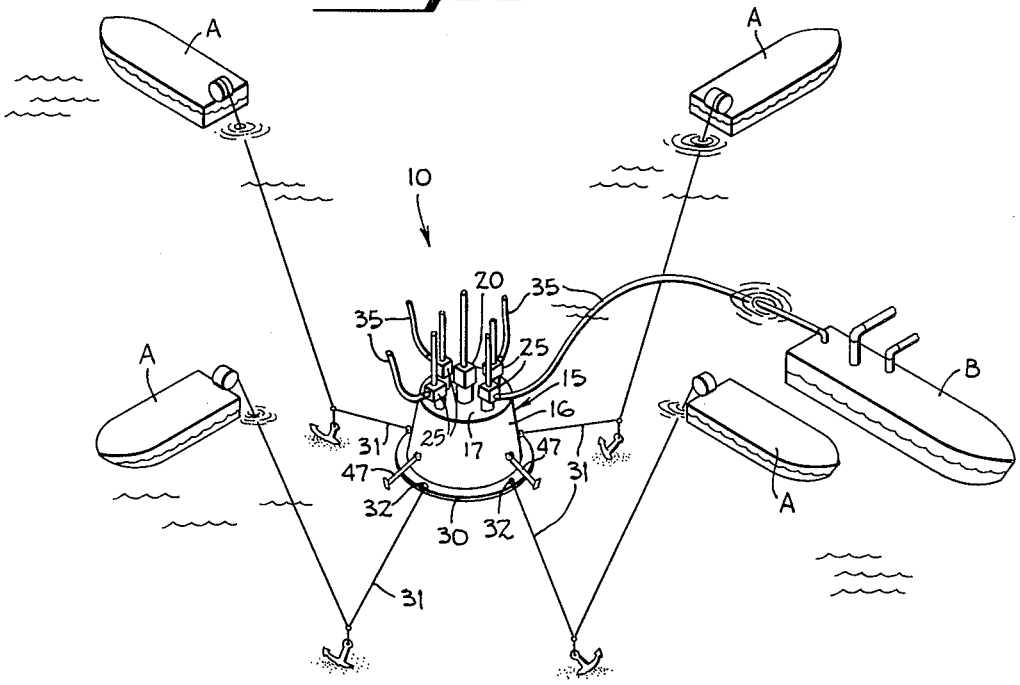
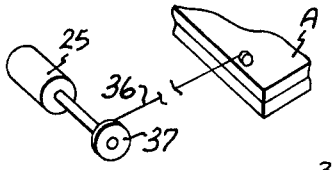
Fig_5
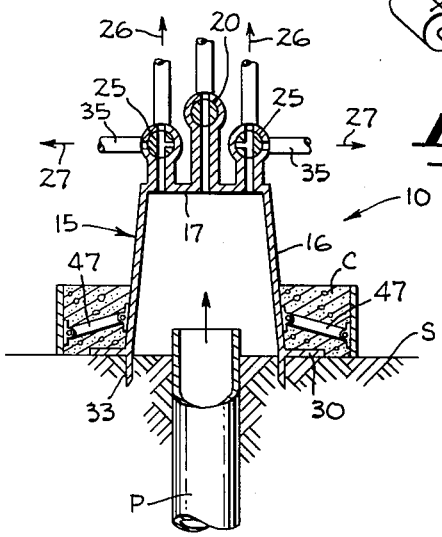
Fig_2
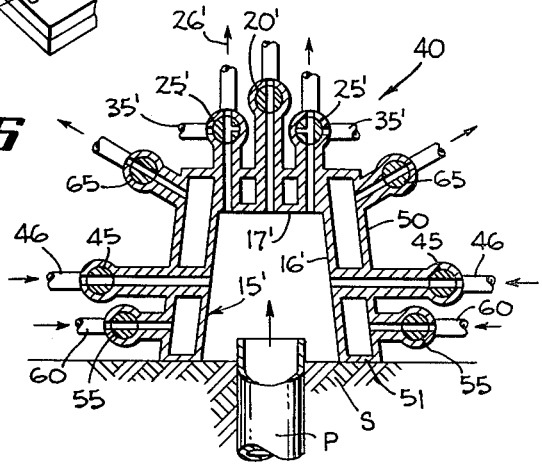
Fig_3
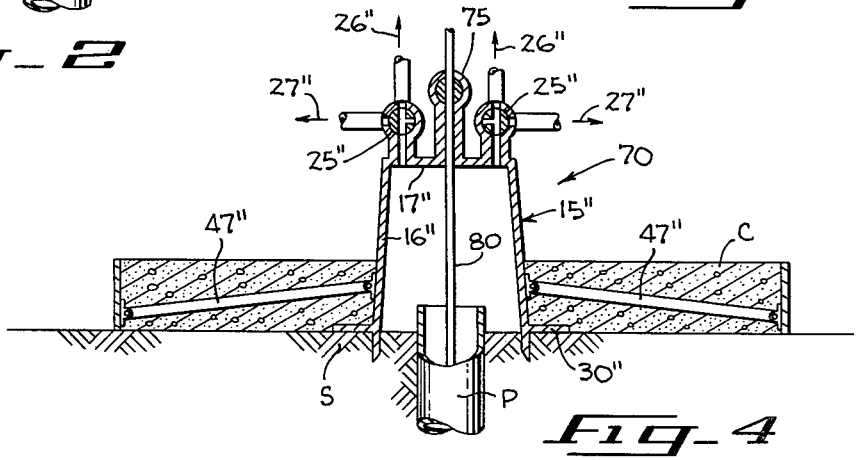
Fig_4

APPARATUS FOR CONTROLLING AND PREVENTING OIL BLOWOUTS

BACKGROUND OF THE INVENTION

The present invention relates in general to apparatus for controlling blowouts from oil wells or offshore oil rigs, and more particularly to a dome for controlling blowouts from oil wells or offshore oil rigs.

In the patent to Sievern et al, U.S. Pat. No. 1,859,606, issued May 24, 1932, for Oil Saving Dome, there is disclosed a dome disposed over a well head. At the top of the dome is an axially disposed valve. Concentrically disposed at the top of the dome about the valve are openings communicating with valves through conduits. The conduits are connected to the valves for conducting oil into storage facilities.

The patent to Jones, U.S. Pat. No. 3,664,429, issued on May 23, 1972, for Apparatus For Preventing Pollution From Offshore Oil Wells discloses a container for an offshore oil well. An inlet pipe introduces carbon dioxide or water into the container for extinguishing a fire. In the patent to Verdin, U.S. Pat. No. 3,554,290 issued on Jan. 12, 1971, for Oil Pollution Control And Fire Extinguishing Apparatus And Method, there is disclosed an enclosure for an oil blowout emanating from an offshore oil well. The enclosure has discharge heads and pipes in the well thereof for introducing fire retardant material into the interior of the enclosure. Hatches on the top of the enclosure have remotely operated sliding covers which are selectively opened during the lowering of the enclosure to surround the well head.

In the patent to Teel, U.S. Pat. No. 1,807,498, issued on Feb. 12, 1929, for Well Capping Device, there is disclosed a bell-shaped dome that is placed in the ground surrounding a well head. Cement is poured inside of the dome. Valves for lead-off pipes are opened, while the dome is positioned over the well head, and cement is poured into the interior of the dome, after the dome is seated on the ground surrounding the well head. The patent to Murphy, U.S. Pat. No. 1,857,788, issued on May 10, 1932, for Method And Apparatus For Extinguishing Gas And Oil Well Fires, discloses a conical opening communicating with a well head. Concrete is poured around the conical opening. A valve on the top of the concrete block has a hand wheel to open and close the valve. Conduits in the concrete block permit the escape of steam from the interior of the block.

The patent to Featherstone, U.S. Pat. No. 1,520,288, issued on Dec. 23, 1924, for Fire Extinguisher discloses a dome over a well head and discharging chemicals into the dome for extinguishing a fire. Outlets at the top of the dome permit gas under pressure to escape while the dome is being placed in position over the well head.

Other U.S. patents of interest are:

Howe No. 1,830,061

Chiasson et al. No. 3,724,555

Chiasson et al. No. 3,815,682

In an article entitled "Blowout" appearing in the publication "The Work Boat", November 1979, pp. 45–48 and 89–91, there are discussions of bleeding off oil into waiting tankers and using funnels with a valve at the top to be hung over the blow out pipe of the well.

SUMMARY OF THE INVENTION

Apparatus for controlling oil blowouts from an offshore oil rig or an oil well comprising a hollow dome with a main valve centrally located on the top thereof for the passage of blowoff oil or gas escaping from a discharge pipe. Disposed concentrically about the main valve at the top of the dome is a plurality of valves. Conduits are connected to the concentrically disposed valves for conducting oil or gas escaping from a discharge pipe to a storage facility.

One of the features of the present invention is that the concentrically disposed valves are two-way valves. By operating the two-way valves in selecting the open position thereof, the two-way valves can be employed either for blowoff purposes or for storing gas or oil in suitable storage facilities.

A feature of the present invention is the selective remote control over the opening and closing of the concentrically disposed valves through flexible cables. In the event of a fire, the concentrically disposed valves are selectively closed in the fire zones only to shut off a supply of fuel to the fire in the fire zone.

Another feature of the present invention is the imbedding of the dome in concrete along the exterior wall thereof to seal the dome to the bottom surface surrounding the discharge pipe and to secure the dome in a fixed position.

Another feature of the present invention is the installation of valves communicating with the dome. Conduits with chemical fire retardants are connected to the certain valves. By controlling the opening and closing of these valves, chemical fire retardants are selectively discharged into the interior of the dome through the valves for extinguishing a fire in the fire zone. Conduits for the passage of water are connected to other valves. By controlling the opening and closing of the other valves, chemicals are poured into the interior of the dome for extinguishing a fire. Check valves also communicate with the dome for the escape of steam generated within the dome.

Still another feature of the present invention is the arrangement for a drill to pass through the main valve and the dome for entry into the discharge pipe of the oil rig or oil well.

DESCRIPTION OF THE DRAWINGS

FIG. 1 is a diagrammatic illustration of the apparatus of the present invention for controlling oil blowout from an oil rig illustrated with boats for the lowering thereof and illustrated connected to an oil barge for the storing of gas or oil.

FIG. 2 is a diagrammatic vertical axial section view of the apparatus shown in FIG. 1.

FIG. 3 is a diagrammatic vertical axial section view of a modification of the apparatus shown in FIGS. 1 and 2 illustrating valves communicating with the dome for the selective conduction of chemical fire retardants into the dome, for the pouring of chemicals into the dome and for the venting of steam from the dome.

FIG. 4 is a diagrammatic vertical axial section view of a further modification of the apparatus shown in FIGS. 1 and 2 illustrating a dome with a main valve disposed at the top thereof and arranged for a conduit to be received therein for the passage of a drill through the dome to enter a discharge pipe.

FIG. 5 is a fragmentary diagrammatic illustration of the apparatus of the present invention for controlling oil blowout from an oil rig illustrated with means for controlling valves from a remote location.

DESCRIPTION OF THE PREFERRED EMBODIMENTS

Illustrated in FIGS. 1 and 2 is apparatus 10 embodying the present invention for controlling oil blowouts from an offshore oil rig or from an oil well. The apparatus 10 comprises a hollow dome 15 made of suitable material capable of withstanding high fluid pressures. In the preferred embodiment, the dome 15 has a frustoconical configuration.

The dome 15 includes a truncated conical wall 16 and a top wall 17. Mounted on the top wall 17 along the axis of the truncated conical wall 16 is a main valve 20. The main valve 20 is either opened or closed. When opened, the main valve 20 provides a path for the blowoff or escape of oil or gas discharged from the pipe P.

Mounted on the top wall 17 concentrically about the main valve 20 is a plurality of two-way valves 25. The two-way valves 25 may be opened or closed. When opened, the flow of oil or gas through the valves 25 may be either in the direction of an arrow 26 or in the direction of an arrow 27. When the flow of gas or oil through the valves 25 is in the direction of the arrows 26 (FIG. 2), a path is provided for the blowoff or escape of oil or gas discharged from the pipe P through the dome 15. When the flow of gas or oil through the valves 25 is in the direction of the arrows 27 (FIG. 2), a path is provided for the storage of gas or oil in a barge, tank or other suitable storage facility.

As shown in FIG. 2, the dome 15 is disposed around the discharge end of a pipe P of an offshore oil rig or of an oil well. The apparatus 10 is intended for use in controlling and preventing oil or gas blowout from the pipe P.

Initially, the dome 15 is lowered to seat on the bottom surface S surrounding the discharge end of the pipe P. When the dome 15 is lowered onto the bottom surface S surrounding the discharge end of the pipe P, the main valve 20 is opened. Also, the concentrically disposed valves 25 are opened during the lowering of the dome 15 to permit the blowoff or escape of liquids and fluids discharged from the pipe P over a path shown by the arrows 26. The blowoff during the lowering of the dome 15 is through the valve 20 and the valves 25. It is within the contemplation of the present invention to have the apparatus 10 as part of a permanent installation so as to be positioned for use prior to a blowoff or a fire.

When the pipe P is part of an offshore oil rig, the dome 15 is lowered by boats A spaced about the pipe P. Hoists on the boats with suitable cables fixed to eyebolts on the dome 15 may be employed to raise or lower the dome 15. In the exemplary embodiment, the dome 15 is provided with an annular flange 30 on which is fixed angularly spaced apart eyebolts. Cables 31 are secured to the eyebolts 32. A depending annular flange 33 projects downwardly from the wall 16 to penetrate the bottom surface S. When the pipe P is part of an oil well, the dome 15 may be lowered by a crane or the like. The cable of the crane would then be attached to an eyebolt located centrally on the top wall.

After the dome 15 is fully lowered, it seats on the bottom surface S with the flange 30 resting on the surface S. The dome 15 (FIG. 2) surrounds the discharge pipe P. Concrete C is poured along the exterior wall of the dome 15 to surround the dome 15. In so doing, the dome 15 is sealed to the bottom surface S and the dome 15 is fixedly secured in position. Arms 47 are pivotally connected to the conical wall 16 of the dome 15 to guide and retain the dome 15 in a preselected location for the pipe P during the lowering of the dome 15. The free end of the arms 47 include a pivotal guide plate for free movement against a retainer wall. The pivotal arms 47 are embedded in the concrete C after the dome 15 is properly seated.

Connected to one outlet of the concentrically disposed valves 25, respectively, are conduits 35. The discharge ends of the conduits 35 are connected, respectively, to suitable storage facilities, such as barge B (FIG. 1), tanks, not shown, or the like. When the valves 25 are opened, respectively, for gas or oil to flow over the paths 27, gas or oil discharged from the pipe P flows from the dome 15, through the valves 25, through the conduits 35 and into storage facilities, such as barge B, tanks or the like.

Should the apparatus 10 be installed after a blowout has occurred, then the valve 20 is opened and the valves 25 are opened to direct a flow of gas or oil over the paths shown by the arrows 26 while the dome 15 is being lowered onto the bottom surface S. After the concrete C has been poured and cured, then the valves 25 are opened to direct a flow of gas or oil over the paths shown by the arrows 27 for depositing the oil or gas into a storage facility, such as the barge B, a tank or the like, through the conduits 35. In the event of a fire, the valves 25 are selectively closed in the fire zones to shut off a supply of fuel to the fire in the fire zones.

Should the apparatus 10 be installed before a blowout has occurred, or a fire has occurred, and during normal operations, the dome is installed and concrete poured on the surface S in the manner heretofore described. During the normal operation, the valve 20 is closed and the valves 25 are opened to direct a flow of gas or oil over the paths shown by the arrows 26 for depositing the oil or gas into a storage facility, such as the barge B, a tank or the like through the conduits 35.

The valve 20 and the valves 25 are respectively remotely controlled by flexible cables 36 in a well-known manner. It is contemplated that the valves may be opened respectively by electric motors with worm gears. If desired, a hand crank or wheel 37 can be employed to open the valves manually. The valves 20 and 25 include valve control wheels 37 which are operated in a well-known manner by flexible cables 36.

Illustrated in FIG. 3 is an apparatus 40 for controlling oil blowouts from an offshore oil rig or oil well, which is a modification of the apparatus 10 shown in FIGS. 1 and 2. Parts of the apparatus 40 corresponding to similar parts of the apparatus 10 are shown with the same reference numeral but with a prime suffix. Disposed in the truncated wall 16' are conventional valves 45, which communicate with the interior of the hollow dome 15'. Connected to the inlet side of the valves 45 are conduits 46. The conduits 46 are connected to a supply of a suitable chemical fire retardant under pressure. By opening the valves 45, chemical fire retardants are discharged into the dome 15' for extinguishing a fire.

An outer shell 50 extends above the top wall 17' and from a bottom wall 51 of the dome 15' in spaced relation to the truncated conical wall 16' of the dome 15'. Disposed in the outer shell 50 are suitable valves 55. Connected to the inlet side of valves 55 are conduits 60. The conduits 60 are connected to a supply of water under pressure. When the valves 55 are opened, water under pressure is conducted into the space between the dome 15' and the shell 50 for keeping dome 15' cool. The space between the dome 15' and the shell 50 provides a water jacket for use in the event of a fire in a well located on land. Passages between the top wall 17' of the dome 15' and the top wall of the shell 50 permit the flow of water therebetween.

Disposed in the shell 50 at the upper section thereof are suitable check valves 65. Steam formed between the shell 50 and the dome 15' during a fire vents through the check valves 65.

Illustrated in FIG. 4 is an apparatus 70 for controlling blowouts from an offshore oil rig or oil well, which is further modification of the apparatus 10 shown in FIGS. 1 and 2. Parts of the apparatus 70 corresponding to similar parts of the apparatus 10 are shown with the same reference but with a double prime suffix. The apparatus 70 includes a main valve 75 through which a drill 80 may pass through for entry into the discharge pipe P.

I claim:

1. Apparatus for controlling oil blowouts in oil rigs, oil wells and the like comprising a hollow dome having an exterior wall, means providing a plurality of discharge openings in said wall, a valve communicating with each of said openings and adapted to control the flow of fluid through the openings, and a pair of conduits connected to each valve, one conduit leading to a storage facility and the other conduit providing a blow off passage, each valve being movable between a first position establishing communication between the associated storage conduit and the associated discharge opening and a second position communicating the discharge opening with said blowoff passage.

2. Apparatus as claimed in claim 1 and comprising valve means communicating with the interior of said dome for controlling the passage of chemical retardants in said dome for extinguishing a fire.

3. Apparatus as claimed in claim 1 and comprising a shell disposed exteriorly of and spaced from said dome to form a water jacket therebetween, and valve means communicating with the space between said dome and said shell for controlling the passage of water between said dome and said shell for cooling said dome.

4. Apparatus as claimed in claim 3 and comprising valve means communicating with the space between said dome and said shell for the venting of steam in said space

5. Apparatus for controlling oil blowouts in oil rigs, oil wells and the like comprising a dome having a generally frusto-conical exterior wall, a flange secured to and extending radially outwardly from the lower circumferential edge of said wall, and concrete disposed on said flange and overlapping the radially outer edge of said flange to engage the ground around said flange, said concrete being adapted to hold said dome in place.

6. Apparatus according to claim 5 further comprising an upright, generally cylindrical wall disposed around and radially outwardly of said dome, and means connecting said wall to said dome for adjusting movement relative thereto.

7. Apparatus according to claim 6 wherein said connecting means includes a plurality of arms pivotally connected to said dome and to said wall.

* * * * *